US007507298B2

(12) United States Patent
Falster-Hansen et al.

(10) Patent No.: US 7,507,298 B2
(45) Date of Patent: Mar. 24, 2009

(54) CLEANING EQUIPMENT AND USE THEREOF

(75) Inventors: Henrik Falster-Hansen, Tølløse (DK); Ib René Vinther Elgaard, Hornbæk (DK)

(73) Assignee: Alfa Laval Tank Equipment A/S, Ishoj (DK)

( * ) Notice: Subject to any disclaimer, the term of this patent is extended or adjusted under 35 U.S.C. 154(b) by 424 days.

(21) Appl. No.: 10/488,829

(22) PCT Filed: Sep. 5, 2002

(86) PCT No.: PCT/DK02/00575

§ 371 (c)(1),
(2), (4) Date: Jul. 6, 2004

(87) PCT Pub. No.: WO03/022464

PCT Pub. Date: Mar. 20, 2003

(65) Prior Publication Data

US 2004/0238009 A1 Dec. 2, 2004

(30) Foreign Application Priority Data

Sep. 7, 2001 (DK) ..... 2001 01319

(51) Int. Cl.
*B08B 9/093* (2006.01)

(52) U.S. Cl. ..... 134/21; 134/22.1; 134/22.11; 134/168 R; 134/167 R; 134/166 R

(58) Field of Classification Search ..... 134/10, 134/22.1, 22.18, 24, 166 R, 167 R, 168 R, 134/169 R, 172, 133, 188, 198
See application file for complete search history.

(56) References Cited

U.S. PATENT DOCUMENTS

| | | | | |
|---|---|---|---|---|
| 2,559,518 | A | 7/1951 | Smith | |
| 2,592,904 | A | 4/1952 | Jackson | |
| 3,496,881 | A | 2/1970 | Bylsma | |
| 3,645,452 | A * | 2/1972 | Stoeckel et al. | 239/227 |
| 3,878,857 | A * | 4/1975 | Heibo | 134/167 R |

(Continued)

FOREIGN PATENT DOCUMENTS

| | | |
|---|---|---|
| DE | 100 09 372 A1 | 2/2000 |

(Continued)

*Primary Examiner*—Michael Barr
*Assistant Examiner*—Jason P Riggleman
(74) *Attorney, Agent, or Firm*—William J. Sapone; Coleman Sudol Sapone P.C.

(57) ABSTRACT

By constructing tank cleaning equipment according to the invention such that it comprises a cleaning jetting part (7, 9) as well as a suction part (4), the equipment can work with the same cleaning medium which is recirculated. This saves supply of fresh cleaning medium, and since used medium is thus not discharged, it is not necessary to establish deposit facilities to avoid pollution. Furthermore, this equipment according to the invention may advantageously be used for keeping so-called drilling mud in a mixed and thus ready-to-use state, even when left to stand for an extended period of time in a tank. The nozzle jets (10) thus keep the mud in the tank in a constantly mixed state, and the mud can therefore be sucked through the suction pipe (20) for pumping in the drill pipe, it being ensured that the mud is homogeneous and has a suitable viscosity.

6 Claims, 1 Drawing Sheet

U.S. PATENT DOCUMENTS 4,106,950 A 8/1978 Grismer
4,828,625 A * 5/1989 Moran ..... 134/22.18
5,078,799 A * 1/1992 Matter et al. ..... 134/22.18
5,117,857 A * 6/1992 Smith ..... 137/240
5,445,173 A 8/1995 Aiken
5,558,434 A 9/1996 Hamada et al.
5,876,512 A * 3/1999 Desormeaux et al. .... 134/22.18

FOREIGN PATENT DOCUMENTS

JP 11188328 A * 7/1999
WO WO-01/11155 A1 * 4/2000
WO WO 01/07178 A1 2/2001

* cited by examiner

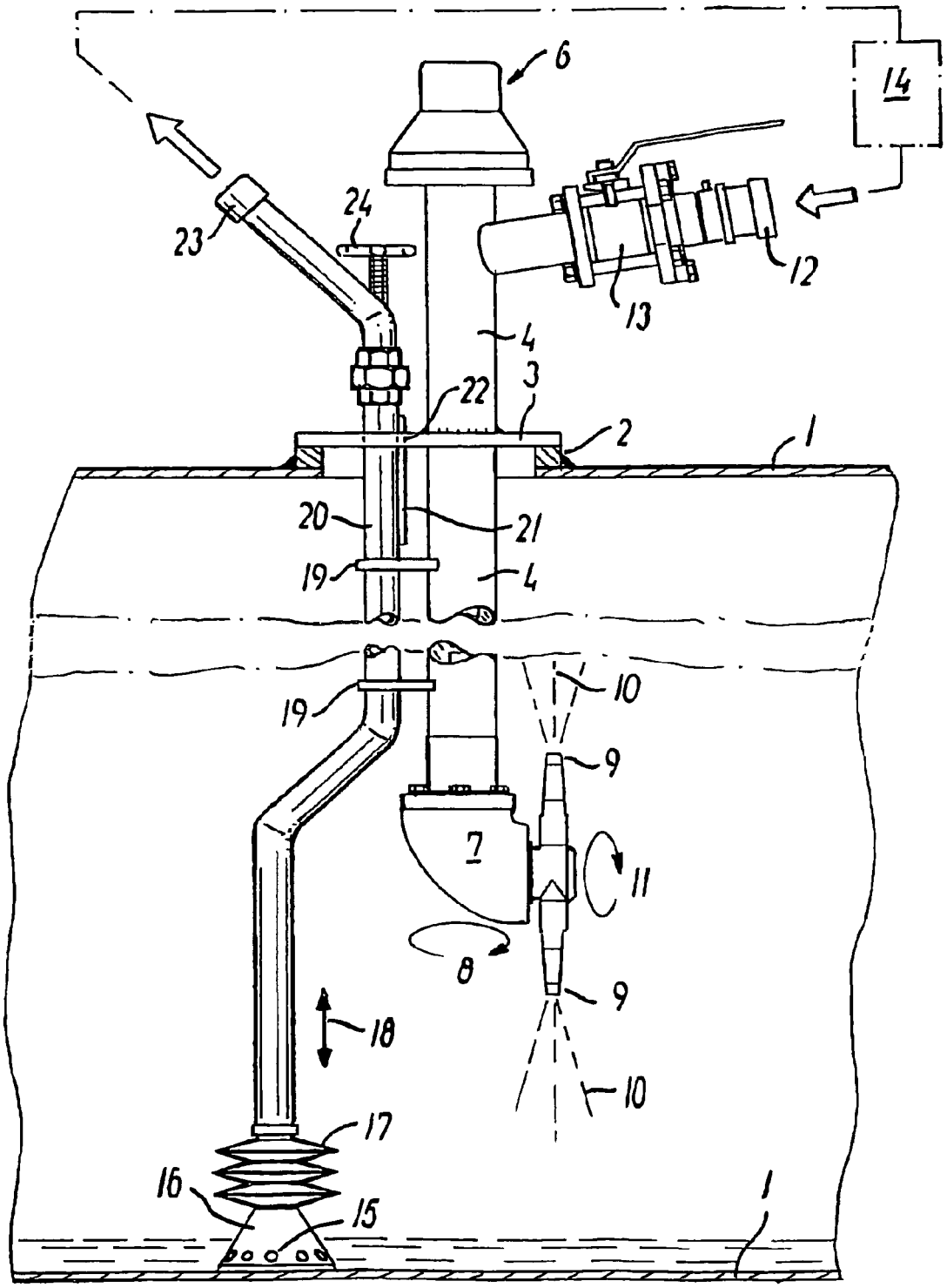
6
14
24
23
12
13
4
3
22
2
1
20
21
19
4
10
19
9
7
11
8
9
18
10
17
16
15
1

CLEANING EQUIPMENT AND USE THEREOF

STATE OF THE ART

The invention relates to cleaning equipment for the cleaning of a tank space by means of pipe lowered into the tank space with cleaning equipment comprising a revolving cleaning head with rotating nozzles, and from which cleaning medium is discharged, as well as use of the equipment.

Cleaning equipment of this type is used in particular for the cleaning of various forms of tank spaces for use in process technology, the food industry as well as storage tanks.

Cleaning takes place by means of flushing from rotating and revolving nozzles so that the entire internal surface of the tank space is flushed. Material settled on the tank wall and the cleaning medium must subsequently be pumped out and collected. This cleaning medium with suspended material is frequently a problem, since it must be stored for subsequent cleaning in order to avoid pollution. To this should be added that this cleaning process must be supplied with an uninterrupted flow of cleaning medium, which requires a considerable amount of cleaning liquid.

This is a drawback where limited amounts of cleaning medium are available, such as on drilling platforms and similar locations, just as it requires a sufficient tank capacity for the storage of the cleaning medium pumped out.

OBJECT OF THE INVENTION

The object of the invention is to remedy these drawbacks and defects, and this is achieved according to the invention by cleaning equipment, where the cleaning equipment additionally comprises a suction pipe extending from the bottom of the tank space and out of the tank space, said suction pipe being connected with the suction side of a pump, while the delivery side of the pump is connected with the nozzles of the cleaning head.

Cleaning of tank spaces may be carried out in this surprisingly simple manner by recirculating the cleaning medium. In this manner, the amount of cleaning medium is limited, and the problem of discharging polluted medium is effectively remedied, since the cleaning medium may be re-used.

If the cleaning medium is cleaned, e.g. in that coarse particles are filtered off in a filter, the cleaning medium may be re-used several times.

When the equipment is constructed such that it may be mounted in one and the same hole in the tank, the installation is very compact, and the mounting is therefore simpler and less expensive.

When the suction pipe is constructed such that it may be adjusted in height from the outside, the same equipment may be adapted to various tank dimensions.

When the cleaning medium is recirculated, it may be used in locations where a limited amount of cleaning medium is available, and where discharge of polluted cleaning medium is not allowed.

Finally, it is expedient to use the equipment to ensure a homogeneous and fluid drilling mud which is used for lubrication and pressure seal-off around the drill in the drill pipe.

THE DRAWING

An example of an embodiment of the equipment according to the invention will be described more fully below with reference to the drawing, which shows a section through a tank with the equipment mounted.

DESCRIPTION OF THE EXAMPLE OF AN EMBODIMENT

The drawing shows an example of a preferred embodiment of the equipment according to the invention.

The tank in which the equipment is mounted is indicated with an upper and lower tank wall 1.

The top of the tank is formed with a hole at which a flange 2 is mounted.

A cover 3 is secured to this flange 2. Where the equipment is not mounted, the cover is a so-called closed cover, which is fixedly bolted in a generally known manner.

When the cleaning equipment is to be mounted, the cover is removed, and the cover 3 shown in the drawing is mounted, through which a cleaning pipe 4 as well as a suction pipe 20 may be passed.

The cleaning pipe 4 is normally welded to the cover 3, protruding a distance above the cover and such that a drive means (not shown) for a coupling member 6 may be mounted Furthermore, a supply stub 12 for the supply of cleaning medium under pressure is provided.

A valve 13 controls the supply of this medium.

The cleaning pipe 4 internally mounts a drive shaft which, via the drive equipment, can revolve the cleaning head 7 mounted at the end such that the cleaning head revolves as indicated by an arrow 8.

The cleaning head 7 is moreover provided with rotating nozzles 9 which rotate in the direction of the arrow 11 during cleaning at the same time as the cleaning head revolves.

The cleaning medium is fed to the pipe 4 and is discharged through the nozzles 9 to form the cleaning jets 10.

When cleaning takes place, the cleaning head revolves while the nozzles rotate, which results in a great cleaning effect and provides the certainty that all internal faces are swept uniformly by the cleaning medium.

Also a suction pipe 20 is passed through the cover and is mounted with a longitudinal key 21 secured at the side and extending in a keyway 22 in the cover 3. In addition, a plurality of guides 19 for the suction pipe 20 are secured on the cleaning pipe 4.

A raising/lowering system e.g. in the form of a spindle 24 is mounted such that the suction pipe 20 may be displaced relative to the cover and thereby relative to the tank space.

The purpose of this height adjustability is to adjust the suction end of the suction pipe 20 relative to the bottom of the tank.

As indicated in the drawing, a bellows member 17 may be mounted for accommodating any movement in the longitudinal direction, just as a hopper 16 with inlet holes 15 on the circumference is mounted.

The suction pipe 20 protrudes a distance above the cover 3 and is provided with a hose coupling member 23 at the end.

By means of this, a suction hose may be connected to a pump 14, said pump being connected with the cleaning pipe 4 at the delivery side, so that cleaning medium may be discharged via the nobles 9 into the tank space.

The cleaning medium will be recirculated in a completely closed circuit during the cleaning.

As needed, a filter arrangement (not shown) may be inserted in a generally known manner between the suction side and the delivery side so that at least a coarse filtration takes place.

In this manner, the same cleaning medium may be re-used, thereby obviating the need for a constant supply of fresh cleaning medium and also the need for collection/discharge of used and dirty cleaning medium.

Moreover, it has been found that the equipment is extremely suitable for use in tanks in which so-called drilling mud is stored.

This drilling mud consists of clay and specially developed chemicals which are mixed with water and/or oil.

It is used for lubricating the movable parts of the drill head and for flushing the loosened subsoil material away from the drill head. It moreover forms a sealing layer between the drill and the drill pipe when it is pumped in the drill pipe.

The problem of this drilling mud is that at standstill it tends to disintegrate into components where the heavy parts will precipitate. The drilling mud cannot be used in this state, as it functions only when it is in a homogeneous state.

It has surprisingly been found that the drilling mud may advantageously be deposited in a tank in which equipment corresponding to the cleaning equipment described above is mounted.

In this use, mixing water/oil must be supplied to the cleaning equipment, which will keep the drilling mud suitably mixed and conditioned by its nozzle movement. At the same time, drilling mud ready for use may be sucked out via the suction pipe, and may then be pumped down into the drill pipe, the drill string.

This saves a considerable amount of work, as the mixed drilling mud, which is left to stand for an extended period of time, may be kept mixed and ready for use.

The invention claimed is:

1. Cleaning equipment for cleaning a tank having a tank space for storing liquid therein, the tank having a top opening leading to the tank space, the cleaning equipment being mountable to the opening on the tank, the cleaning equipment comprising:

a cover for attachment to the opening, a cleaning pipe mounted to the cover and extending therethrough, the cleaning pipe being lowered through the opening into the tank space when the cover is fitted to the opening;

a revolving cleaning head connected to the cleaning pipe and having rotatable nozzles, from which a cleaning medium is discharged;

a suction pipe movably mounted to the cover and extending therethrough, the suction pipe being disposed along side of the cleaning pipe and being vertically displaceable relative thereto, the suction pipe extending through the cover from the top opening of the tank to a bottom of the tank space, the suction pipe being connected to a suction side of a pump, a delivery side of the pump being connected with the cleaning pipe leading to the rotatable nozzles of the revolving cleaning head, the suction pipe drawing in and mixing the discharged cleaning medium and the stored liquid contained in the tank space for recirculation to effect cleaning of the tank space, means for adjusting a length of the suction pipe extending into the tank space to accommodate tanks of different dimensions and to adjust a suction end of the suction pipe relative to the bottom of the tanks of different dimensions, the means for adjusting the length including one or more guides extending from the cleaning pipe for guiding the vertically movable suction pipe, a longitudinal key secured on the suction pipe, the cover having a keyway provided therein with the longitudinal key movable therein, a spindle being mounted on the cover externally of the tank space and engaged with the suction pipe, a handle mounted on the spindle, rotation of the handle vertically raising or lowering the suction pipe relative to the cover and thereby the suction end relative to the bottom of the tank.

2. The cleaning equipment according to claim 1 further comprising a bellows member mounted to an end of the suction pipe for accommodating longitudinal movement thereof.

3. The cleaning equipment of claim 1 further comprising a hopper mounted to an end of the suction pipe having inlet holes located about a circumference thereof, for drawing therethrough the stored liquid and discharged cleaning fluid at the tank bottom.

4. The cleaning equipment of claim 1 further comprising a filter disposed between the suction side and the delivery side of the pump for filtering coarse particles.

5. The cleaning equipment of claim 1 further comprising a drive shaft internally mounted in the cleaning pipe for revolving the cleaning head mounted to the pipe.

6. A method for cleaning a tank having a tank space containing a stored liquid, the tank space being accessible through a top opening, the method comprising:

providing a cleaning equipment unit for being lowered through the top opening into the tank space, the cleaning equipment unit having a cover for fitting to the opening, a cleaning pipe mounted to the cover for extending into the tank space, a revolving cleaning head connected to the cleaning pipe and having rotatable nozzles, from which a cleaning medium is discharged, a suction pipe movably mounted to the cover for extending into the tank space disposed along side of the cleaning pipe, the suction pipe extending to a bottom of the tank space, means for adjusting a length of the suction pipe extending into the tank space to accommodate tanks of different dimensions and to thereby locate the suction pipe adjacent the bottom of the tanks of different dimensions, the means for adjusting including one or more guides extending from the cleaning pipe for guiding the movable suction pipe, a longitudinal key secured on the suction pipe, the cover having a keyway provided therein within which the longitudinal key is movable, a spindle being mounted on the cover, the spindle used to raise or lower the suction pipe vertically relative to the cover and thereby a suction end of the suction pipe relative to the bottom of the tank, the spindle having a rotatable handle such that manual rotation of the handle raises or lowers the suction pipe, the suction pipe being connected to a suction side of a pump, a delivery side of the pump being connected with the cleaning pipe leading to the rotatable nozzles of the revolving cleaning head;

lowering the cleaning equipment unit into the tank space through the top opening, and mounting the cover of the cleaning equipment unit thereto, thereby locating the cleaning pipe having the revolving cleaning head with rotatable nozzles in the tank space and the suction pipe in the tank space for sucking the stored liquid thereinto;

manually rotating the handle for raising or lowering the suction pipe within the tank to adjust the location of the suction end thereof vertically relative to the bottom of the tank;

connecting the suction pipe to a suction side of a pump, connecting a delivery side of the pump to the cleaning pipe leading to the nozzles of the cleaning head; and, cleaning the tank space by sucking the stored liquid out of the tank and discharging the stored liquid as a cleaning medium from the rotating and revolving nozzles therein.

* * * * *